US012742555B2

(12) United States Patent
Adam et al.

(10) Patent No.: US 12,742,555 B2
(45) Date of Patent: Sep. 22, 2026

(54) COOKING DEVICE WITH TWO FLOW CHANNELS BELOW THE MUFFLE

(71) Applicant: BSH Hausgeräte GmbH, Munich (DE)

(72) Inventors: Julien Adam, Lingolsheim (FR); Victorien Bierg, Schiltigheim (FR); Christophe Cadeau, Blaesheim (FR); Hakim Marko, Illkirch-Graffenstaden (FR)

(73) Assignee: BSH Hausgeräte GmbH, Munich (DE)

( * ) Notice: Subject to any disclaimer, the term of this patent is extended or adjusted under 35 U.S.C. 154(b) by 551 days.

(21) Appl. No.: 18/031,914

(22) PCT Filed: Oct. 27, 2021

(86) PCT No.: PCT/EP2021/079764
§ 371 (c)(1),
(2) Date: Apr. 14, 2023

(87) PCT Pub. No.: WO2022/101006
PCT Pub. Date: May 19, 2022

(65) Prior Publication Data

US 2023/0383957 A1 Nov. 30, 2023

(30) Foreign Application Priority Data

Nov. 10, 2020 (EP) ..... 20290077

(51) Int. Cl.
*F24C 15/00* (2006.01)

(52) U.S. Cl.
CPC ..... *F24C 15/006* (2013.01)

(58) Field of Classification Search
CPC ..... F24C 15/006; F24C 15/322
(Continued)

(56) References Cited

U.S. PATENT DOCUMENTS 4,180,049 A * 12/1979 Carr ..... H05B 6/642 219/400
7,368,684 B2 5/2008 Kim
(Continued)

FOREIGN PATENT DOCUMENTS

DE 2845869 A1 4/1980
DE 9416398 U1 12/1994
(Continued)

OTHER PUBLICATIONS

Machine Translation of EP 1014002 A2 (Year: 2000).*
(Continued)

*Primary Examiner* — Allen R. B. Schult
*Assistant Examiner* — Amy E Carter
(74) *Attorney, Agent, or Firm* — Michael E. Tschupp; Andre Pallapies; Brandon G. Braun

(57) ABSTRACT

A cooking appliance includes a housing, a muffle arranged in the housing and defining a cooking chamber, a door movably arranged on the housing for closing the cooking chamber, and a flow channel system conducting air suctioned from the surroundings of the cooking appliance in flow channels of the flow channel system in order to cool the door and the housing. The flow channel system, when viewed in a height direction of the cooking appliance, includes an inflow channel extending in the housing and below the muffle such that air flowing through the inflow channel flows from the door into the housing, and an outflow channel extending separate from the inflow channel in the housing and below the muffle such that air flows via the outflow channel out of the housing. The inflow channel and the outflow channel are arranged one over the other when viewed in the height direction.

21 Claims, 2 Drawing Sheets

(58) Field of Classification Search
USPC ..... 126/21 A, 198; 219/757
See application file for complete search history.

(56) References Cited

U.S. PATENT DOCUMENTS

| | | | | |
|---|---|---|---|---|
| 10,260,758 | B2 | 4/2019 | Colozzo | |
| 2005/0133019 | A1* | 6/2005 | Kim | F24C 15/006 126/198 |
| 2007/0125355 | A1 | 6/2007 | Lee | |
| 2008/0184985 | A1 | 8/2008 | Hasslberger | |
| 2018/0152997 | A1 | 5/2018 | Carcano | |
| 2021/0289593 | A1* | 9/2021 | Lee | F24C 7/085 |

FOREIGN PATENT DOCUMENTS

| | | | | |
|---|---|---|---|---|
| DE | 10047016 | A1 | 4/2002 | |
| DE | 102011006075 | A1 * | 9/2012 | F24C 15/2007 |
| EP | 1014002 | A2 * | 6/2000 | F24C 14/00 |
| GB | 2262601 | A * | 6/1993 | F24C 15/006 |
| JP | S5944530 | A | 3/1984 | |

OTHER PUBLICATIONS

DE 102011006075 Machine Translation (Year: 2012).*
International Search Report PCT/EP2021/079764 dated Jan. 21, 2022.
National Search Report CN 202180075712.8 dated Jul. 28, 2025.

* cited by examiner

COOKING DEVICE WITH TWO FLOW CHANNELS BELOW THE MUFFLE

CROSS-REFERENCES TO RELATED APPLICATIONS

This application is the U.S. National Stage of International Application No. PCT/EP2021/079764, filed Oct. 27, 2021, which designated the United States and has been published as International Publication No. WO 2022/101006 A1 and which claims the priority of European Patent Application, Serial No. 20290077.5, filed Nov. 10, 2020 pursuant to 35 U.S.C. 119 (a)-(d).

The contents of International Application No. PCT/EP2021/079764 and European Patent Application, Serial No. 20290077.5 are incorporated herein by reference in their entireties as if fully set forth herein.

BACKGROUND OF THE INVENTION

One aspect of the invention relates to a cooking appliance comprising a housing and a muffle. The muffle is arranged in the housing. A cooking chamber of the cooking appliance is defined by the muffle. The cooking appliance also comprises a door which is movably arranged on the housing. The door is designed to close the cooking chamber. The cooking appliance also comprises a flow channel system, air suctioned into the cooking appliance from the surroundings of the cooking appliance being able to be conducted thereby. The flow channel system has flow channels, this suctioned air flowing through said flow channels in order to cool the door and the housing.

Such designs are known from the prior art. For example, in this context reference may be made to DE 10 2007 005 718 A1 and DE 10 2011 006 075 A1.

In the known appliances, the design of the flow channel system and of a comprehensive airflow guidance in order to cool the components, on the one hand, and to discharge the air from the cooking appliance, on the other hand, is limited.

BRIEF SUMMARY OF THE INVENTION

It is the object of the present invention to provide a cooking appliance in which the flow channel system is improved regarding an airflow guidance for cooling the components and for discharging the air from the cooking appliance.

This object is achieved by a cooking appliance which has the features according to the independent claim.

One aspect of the invention relates to a cooking appliance comprising a housing and a muffle. The muffle is arranged in the housing. A cooking chamber of the cooking appliance is defined by the muffle. The cooking appliance also comprises a door which is movably arranged on the housing. The door is designed to close the cooking chamber. The door is thus correspondingly provided and fitted on the cooking appliance as intended. Moreover, the cooking appliance comprises a flow channel system. Air introduced into the cooking appliance from the surroundings of the cooking appliance can be conducted in a defined manner in the cooking appliance by means of this flow channel system. The flow channel system has flow channels, the air flowing via said flow channels in order to cool the door and the housing. When viewed in the height direction of the cooking appliance, the flow channel system has an inflow channel in the housing and below the muffle. Air flows in a defined manner through this specific inflow channel from the door into the housing. Moreover, when viewed in the height direction of the cooking appliance, the flow channel system has an outflow channel, which is separate from the inflow channel, in the housing and below the muffle. Air can be conducted by means of this outflow channel out of the housing or flows out of the housing as intended and in a defined manner.

Due to such a design of the flow channel system of the cooking appliance it is thus possible to configure a flow concept below the muffle which, on the one hand, permits a defined inflow of air into the housing, coming from the door, and thus permits improved cooling of the housing below the muffle. On the other hand, therefore, a targeted outflow of the air which is no longer required, or the air to be discharged from the housing, is also permitted below this muffle. Thus in this regard an advantageous flow concept can be implemented in a compact design below the muffle. Since, when viewed in the height direction, these two defined flow channels of the flow channel system are configured one over the other and thus virtually stacked, it is possible to implement a very compact cooking appliance in the width direction. In particular, due to this stacking of the defined flow channels one over the other, the flow concept can also be improved below the muffle, on the one hand, with very short paths and, on the other hand, in particular also regarding the introduction of air into the outflow channel. In this regard, it is possible in a particularly advantageous manner to discharge the air which is no longer required from the housing in a comprehensive manner.

In particular in cooking appliances which have standard dimensions in the width direction, therefore, this concept is also advantageous relative to saving installation space. Thus it is possible to continue to maintain such standard widths while permitting the proposed improved flow concept. In particular, such a design is particularly advantageous in cooking appliances which have a width of between 55 cm and 60 cm, in particular of between 59 cm and 61 cm, in particular of 60 cm.

In one exemplary embodiment, when viewed in the height direction of the cooking appliance, the inflow channel is arranged above the outflow channel. This specific arrangement of the aforementioned flow channels one over the other in this height direction advantageously prevents air conducted out of the outflow channel from being undesirably suctioned in again via the inflow channel.

In one exemplary embodiment, the inflow channel and the outflow channel are separated from one another by a common dividing wall or a common defining wall. This means that this dividing wall is both a defining wall of the inflow channel and a defining wall of the outflow channel. In particular, the dividing wall is a single layer. Such a design implements a close and direct stacking of these flow channels one over the other in the height direction. Thus a construction which is as compact as possible can also be provided in the height direction. Moreover, the number of components is also reduced thereby.

In one exemplary embodiment, when viewed in the depth direction of the cooking appliance, an inlet of the inflow channel is configured as a front end of the inflow channel. This inlet thus forms the front termination of the inflow channel, when viewed in the depth direction. Thus a particularly advantageous coupling to the door is permitted in order to be able to introduce the air, which is discharged from the door, directly into this inflow channel below the muffle.

In one exemplary embodiment, this inlet of the inflow channel extends over at least 70 percent, in particular at least 80 percent, in particular at least 90 percent, of the width of the muffle, when measured in the width direction of the cooking appliance. In particular, these percentage width values are configured relative to the housing of the cooking appliance. This is a further advantageous exemplary embodiment since this inlet can thus be designed to be very wide. A comprehensive introduction of air into the inflow channel can be permitted thereby. A particularly homogenous flow into this inflow channel is achieved thereby. Equally, as a result of such a width of the inflow channel a cooling action which is as uniform as possible is also achieved over this width at the same time. A particularly advantageous cooling effect is permitted thereby.

In one exemplary embodiment, the inflow channel is configured over its entire depth, which is measured in the depth direction, with a width as is implemented at the inlet. This also means, in particular, that an outlet of the inflow channel, which is located in the depth direction to the rear of the inlet, has a corresponding width. In one exemplary embodiment, this outlet of the inflow channel is the rear end of the inflow channel. This outlet thus forms the rear termination of the inflow channel.

In one exemplary embodiment, when viewed in the depth direction of the cooking appliance, an outlet of the outflow channel forms a front end of this outflow channel. This outlet, from where the air is to be discharged outwardly as intended, in particular outside the housing, is thus the front or front-side end of this outflow channel. In particular, air can be discharged thereby in a particularly targeted and defined manner over the front side of the housing of the cooking appliance. In particular, the outlet is designed such that the outflowing air is blown out obliquely downwardly. As a result, it is advantageously avoided that air is suctioned in again at the inlet of the inflow channel.

In one exemplary embodiment, this outlet of the outflow channel extends over at least 70 percent, in particular at least 80 percent, in particular at least 90 percent, of the width of the muffle. In particular, these width dimensions also apply relative to the housing of the cooking appliance, in particular regarding a front side of the housing.

An advantage which can be achieved thereby is a comprehensive and simultaneous discharge of air from the housing. Moreover, it is also achieved thereby that a flow pressure is lower when the air flows out of the outflow channel and thus does not flow forcibly to the front out of the housing in an undesirable manner, which could be the case when compared with relatively small outlets of the outflow channel.

In one exemplary embodiment, the inlet of the inflow channel and the outlet of the outflow channel are configured on the front side of the housing. The inlet and the outlet are thus virtually openings of the flow channels which are oriented to the front or to the front side of the housing. The aforementioned flow channels are thus open toward the front.

In one exemplary embodiment, when viewed in the width direction, the inlet of the inflow channel and the outlet of the outflow channel are arranged overlapping with one another. In particular, they are arranged overlapping by at least 30 percent, in particular by at least 40 percent, in particular by at least 50 percent, in particular by at least 60 percent, in particular by at least 70 percent, in particular by at least 80 percent, in particular by at least 90 percent, in this width direction.

In one exemplary embodiment, when viewed in the depth direction of the cooking appliance, the inlet of the inflow channel and the outlet of the outflow channel are located at the same depth position. A correspondingly compact construction can also be permitted thereby in the depth direction. In one exemplary embodiment, however, it is also possible to implement an offset of the inlet of the inflow channel and the outlet of the outflow channel in this depth direction. For example, it is possible to implement an offset in the depth direction which is dimensioned to be less than or equal to 5 cm.

In one exemplary embodiment, the cooking appliance has a fan which is arranged below the muffle, when viewed in the height direction of the cooking appliance. As a result, the installation space below the muffle is utilized particularly advantageously. Not least, an advantageous conveying concept or flow concept can be implemented thereby, in order to suction, on the one hand, air out of the door into the housing by means of the fan and, on the other hand, to blow the air out again in an improved manner via the positionally defined outflow channel. This position of the fan is implemented in the immediate vicinity of this inflow channel and this outflow channel below the muffle, so that in this regard the desired inflow and outflow conditions can be improved.

In one exemplary embodiment, when viewed in the depth direction of the cooking appliance, the fan is arranged to the rear of the inlet of the outflow channel. In one exemplary embodiment, when viewed in the height direction of the cooking appliance, the fan is arranged at the height of the inlet of the outflow channel. Thus it is possible to improve even further the desired flow conditions, on the one hand, relative to suctioning air out of the door into the inflow channel and, on the other hand, the outflow or blowing out of air via the outflow channel. In this regard, improved concepts in terms of flow technology are implemented.

In one exemplary embodiment, when viewed in the direction of flow of the air, the outflow channel is arranged below the muffle in a positive pressure region of the fan. In one exemplary embodiment, when viewed in the direction of flow of the air, the inflow channel arranged below the muffle is arranged in a negative pressure region of the fan.

In one exemplary embodiment, this fan is configured as a centrifugal fan. The particularly advantageous flow conditions can be achieved thereby, in particular in this concept explained above. This applies both to suctioning the air and at the same time to blowing out the air. In one exemplary embodiment, the fan is configured, in particular, as a BLDC (brushless DC) centrifugal fan. This means that this centrifugal fan has a brushless DC motor. Such a design permits a compact construction but with a greater pressure of the airflow, which can be generated thereby.

In particular, this design of the fan can also be implemented advantageously in the above-mentioned position in the housing provided in an exemplary embodiment.

In one exemplary embodiment, the flow channel system has a further inflow channel. This further inflow channel has a first sub-region which is located above the muffle, when viewed in the height direction of the cooking appliance. This first sub-region, when viewed in the depth direction, extends relative to the intended direction of flow of the air flowing therein from front to back in this housing and above the muffle. This further inflow channel also has a second sub-region which adjoins the first sub-region. This second sub-region leads directly to the first sub-region. The second sub-region extends to the rear of the muffle in the housing. The second sub-region extends, in particular, entirely to the rear of the muffle. When viewed in the height direction, this second sub-region extends from top to bottom in the housing. This is also provided once again relative to the direction of flow of the air which is provided as intended in this second sub-region. In one exemplary embodiment, an outlet of the second sub-region is coupled in terms of flow technology to the inlet of the outflow channel. In particular, an indirect coupling is provided here. Thus air which initially flows via this further inflow channel above the muffle in the housing, and then to the rear of the muffle in the housing, can be conducted directly into the outflow channel below the muffle.

The first sub-region of this further inflow channel has an inlet which is configured on a front side of the housing above the muffle. In one exemplary embodiment, it is advantageously achieved thereby that air which flows in the door and is discharged from the door in the upper region can flow directly via this inlet into this further inflow channel. As a result, a very efficient flow concept is permitted in the upper region of the cooking appliance.

In one exemplary embodiment, a catalyzer of the cooking appliance is arranged in this second sub-region of the further inflow channel. The catalyzer is thus arranged spaced apart from the outflow channel. Thus, on the one hand, space is permitted in the region of the outflow channel for other components, in particular the fan, to be arranged immediately adjacent to one another. On the other hand, due to this spaced-apart arrangement of the catalyzer relative to this outflow channel, in particular in the rear region below the muffle, a spacing from the outflow channel is also achieved, so that contaminated air cannot adhere to electrical parts, in particular cannot condense thereon. In particular, in an eco-operating mode of the cooking appliance the catalyzer can be deactivated, but it is still possible to avoid an accumulation of vapors, dirt and dust on electrical parts.

In a further exemplary embodiment, the flow channel system has an inflow channel in the door. This inflow channel in the door has a plurality of inlets. One inlet is configured, in particular, on a door upper edge of the door. At least one further inlet, in particular two further inlets, of this inflow channel are configured on door side edges of the door. Thus in the proposed cooking appliance air is comprehensively suctioned from the surroundings via the door. In particular, therefore, such a suctioning of air from the surroundings only takes place via the door. Due to the air being suctioned in this manner via the door upper edge and the door side edges, air can also pass comprehensively into the cooking appliance. In particular, these specific suctioning positions also assist the concept for the airflow, on the one hand, in the door from top to bottom, and, on the other hand, an improved and more comprehensive inflow of air from the door into the housing. Thus air can pass particularly comprehensively into the cooking appliance and at the same time is distributed at a plurality of points therein. An improved cooling concept and yet at the same time an improved flow management concept is achieved thereby. In particular, the door is also cooled thereby, in particular cooled first.

In the exemplary embodiment, an outlet of this inflow channel in the door is directly coupled in terms of flow technology to the inlet of the inflow channel in the housing which is arranged below the muffle. It can be provided that the outlet of this inflow channel in the door has a width which substantially corresponds to or is equal to the width of the inlet of this inflow channel in the housing below the muffle.

In one exemplary embodiment, the door has only these aforementioned three inlets of the inflow channel in the door. Notwithstanding the concept of an improved and comprehensive flow, the flow behavior of the air in the door and also in the housing can be simplified by the proposed flow channel system. In one exemplary embodiment, all of the flow channels of the flow channel system, apart from the aforementioned outflow channel, can be arranged below the muffle in a negative pressure region of the aforementioned fan. In particular, in the exemplary embodiment, only this one outflow channel is arranged below the muffle which, in particular, also constitutes the single outflow channel of the cooking appliance, in a positive pressure region of the fan. Due to this design a very clean airflow through the flow channel system is also permitted, on the one hand, in the door and, on the other hand, in the inflow channels in the housing. In particular, this concept also permits no undesired airflow leakages to be present in the door and in the housing.

Due to the aforementioned advantageous ventilation concept of the door, a flow concept is permitted in which air virtually flows only from top to bottom in the door. A further outlet of the inflow channel in the door is configured in an upper region of the door. In particular, when viewed in the height direction, this further outlet is located at the same height as the inlet of the further inflow channel in the housing which is located above the muffle in the housing.

Due to the aforementioned advantageous concept of the two flow channels below the muffle in the housing, which are thus located in two levels as already explained above, the advantageous introduction of air can also be achieved from the lower outlet of the inflow channel in the door into the outflow channel in the housing which is located below the muffle. This outlet of the inflow channel in the door is arranged higher, when viewed in the height direction, than the front-side outlet of the outflow channel which is located below the muffle in the housing. As a result, the air escaping from the door and the exhaust air escaping from the outflow channel on the front side cannot be mixed in an undesirable manner.

The positions and orientations provided when the appliance is used as intended and arranged as intended are specified by the terms "above", "below", "front", "rear", "horizontal", "vertical", "depth direction", "width direction", "height direction", etc.

Further features of the invention are found in the claims, the figures and the description of the figures. The features and combinations of features mentioned above in the description and the features and combinations of features mentioned hereinafter in the description of the figures and/or shown individually in the figures are not only able to be used in the respectively specified combination but also in other combinations without departing from the scope of the invention. Thus embodiments of the invention which are not explicitly shown and explained in the figures but which emerge from and can be generated by separate combinations of features from the described embodiments are to be regarded as encompassed and disclosed. Embodiments and combinations of features which thus do not have all of the features of an originally formulated independent claim are also to be regarded as disclosed. Embodiments and combinations of features which go beyond or deviate from the combinations of features set forth in the back-references of the claims are also to be regarded as disclosed, in particular by the embodiments set forth above.

BRIEF DESCRIPTION OF THE DRAWINGS

Exemplary embodiments of the invention are explained in more detail hereinafter with reference to schematic drawings. In the drawings.

DETAILED DESCRIPTION OF EXEMPLARY EMBODIMENTS OF THE PRESENT INVENTION

Elements which are the same or functionally the same are provided in the figures with the same reference signs.

Figure 1:
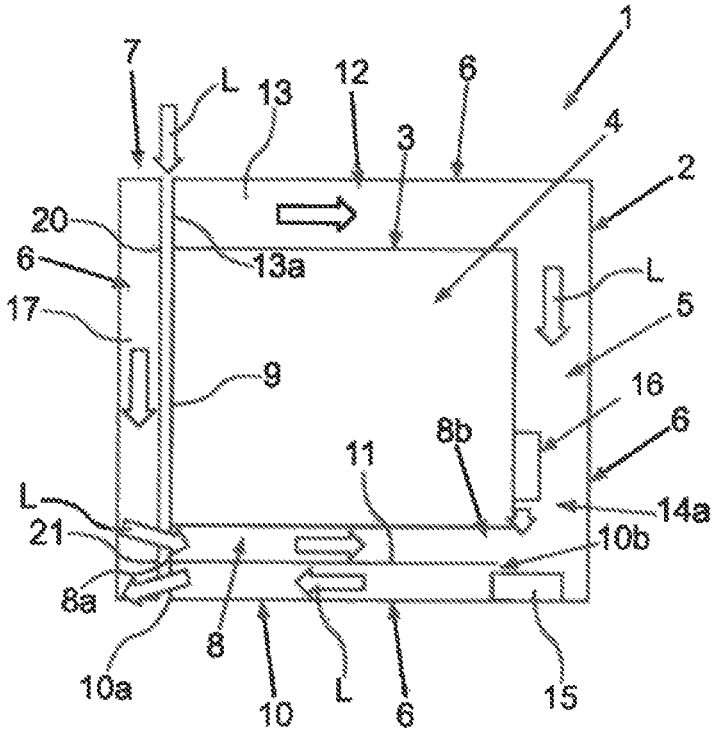
FIG. 1 shows a schematic vertical sectional view of an exemplary embodiment of the cooking appliance according to the invention.

In FIG. 1 an exemplary embodiment of a cooking appliance 1 is shown in a schematic view. The cooking appliance 1 can be, for example, an oven or a steam cooking appliance or a microwave cooking appliance. The cooking appliance can also be a corresponding combi-appliance which has at least two of the aforementioned functionalities.

The cooking appliance 1 is configured for preparing food. The cooking appliance has a housing 2. A muffle 3 is arranged in the housing 2. The muffle 3 defines a cooking chamber 4 with its walls. A cavity 5 is configured between the muffle 3 and the housing 2. On the one hand, thermally insulating material which insulates the muffle 3 is introduced therein. In particular, this thermally insulating material is arranged directly on the outer faces of the walls of the muffle 3.

An arrangement of flow channels of a flow channel system 6 of the cooking appliance 1 is also arranged in the cavity 5.

The cooking appliance 1 also has a door 7. The door 7 is movably arranged on the housing 2. The door 7 is shown in FIG. 1 in the closed state.

The flow channel system 6 has an inflow channel 8 as a flow channel which is configured entirely in the housing 2. The inflow channel 8, when viewed in the height direction (y-direction) of the cooking appliance 1, is configured below the muffle 3. The inflow channel extends, in particular, entirely below this muffle 3. This flow channel of the flow channel system 6 is an inflow channel 8. This means that air L outside the housing 2 can be conducted as intended into the housing 2 by means of this inflow channel 8 or is correspondingly conducted therein. This inflow channel 8 has an inlet 8*a*. This inlet 8*a* forms in the depth direction (z-direction) of the cooking appliance 1 a front end of the inflow channel 8. This front end is configured on a front side 9 of the housing 2. This end or this inlet 8*a* faces the door 7. This inflow channel 8 also has an outlet 8*b*. In the exemplary embodiment the outlet 8*b* represents a rear end of this inflow channel 8. The inlet 8*a* and the outlet 8*b* are arranged below the muffle 3, when viewed in the height direction.

Moreover, the flow channel system 6 has an outflow channel 10 as a flow channel. The outflow channel 10 is arranged entirely in the housing 2. The outflow channel is arranged below the muffle 3. The outflow channel 10 and the inflow channel 8 are arranged one over the other, when viewed in the height direction. In this regard, the outflow channel and the inflow channel are configured and arranged in two different levels below the muffle 3. In particular, the outflow channel 10 is arranged further down than the inflow channel 8. The outflow channel 10 is provided as intended such that air L is discharged from the housing 2. To this end, the outflow channel 10 has an outlet 10*a*. The outlet 10*a* forms a front end of the outflow channel 10, when viewed in the depth direction. The outlet is configured on the front side 9 of the housing 2. The outlet faces the door 7 when this door is closed. In particular, the inlet 8*a* and the outlet 10*a* are configured directly one over the other. In one exemplary embodiment, an inlet 10*b* of the outflow channel 10 forms the rear end of the outflow channel 10. The outlet 10*a* and the inlet 10*b* are arranged below the muffle 3, when viewed in the height direction. The outlet and the inlet are also arranged below the inflow channel 8, in particular below the inlet 8*a* and the outlet 8*b*.

The inflow channel 8 and the outflow channel 10 are directly adjacent to one another. To this end, a dividing wall or, in particular, a single-layer defining wall 11 is provided. This defining wall defines the inflow channel 8 downwardly and the outflow channel 10 upwardly.

As can be identified, the inflow channel 8 and the outflow channel 10 are oriented parallel to one another.

The flow channel system 6 also has a further inflow channel 12 as a flow channel which is configured in the housing 2. In one exemplary embodiment, the inflow channel 12 has a first sub-region 13. The first sub-region is configured entirely above the muffle 3 in the housing 2, when viewed in the height direction. The first sub-region extends entirely above the muffle 3. The first sub-region 13 has an inlet 13*a* which is configured on the front side 9. The first sub-region faces the door 7. Moreover, the further inflow channel 12 has a second sub-region 14. This second sub-region 14 terminates with an inlet directly at an outlet of the first sub-region 13. The second sub-region 14 extends entirely to the rear of the muffle 3 in the housing 2, when viewed in the depth direction. The second sub-region 14 is oriented vertically and extends, in particular, over the entire height of the muffle 3. Accordingly, the first sub-region 13 is oriented entirely horizontally and extends over the entire depth of the muffle 3. An outlet 14*a* of the second sub-region 14 is coupled in terms of flow technology directly to the inlet 10*b* of the outflow channel 10.

It can also be identified that the cooking appliance 1 has a fan 15. The fan 15 is arranged in the housing 2. The fan is arranged below the muffle 3, when viewed in the height direction. In one exemplary embodiment, the fan 15 is arranged in the region of an inlet 10*b* of the outflow channel 10. The fan 15, in particular, is a centrifugal fan, preferably a BLDC centrifugal fan.

Moreover, the cooking appliance 1 has a catalyzer 16. The catalyzer 16 is arranged in the housing 2. The catalyzer is arranged to the rear of the muffle 3. In one exemplary embodiment, the catalyzer is arranged in the second sub-region 14. The catalyzer is arranged spaced apart from the outflow channel 10. When viewed in the height direction, the catalyzer is arranged overlapping with the muffle 3. In particular, the catalyzer is arranged offset upwardly both relative to the inflow channel 8 and relative to the outflow channel 10, when viewed in the height direction.

Moreover, it can also be identified that the door 6 has an inflow channel 17 as a flow channel of the flow channel system 6. Air L is suctioned from the surroundings of the cooking appliance 1 into the door 7 through this inflow channel 17. This takes place by means of the fan 15.

Figure 2:
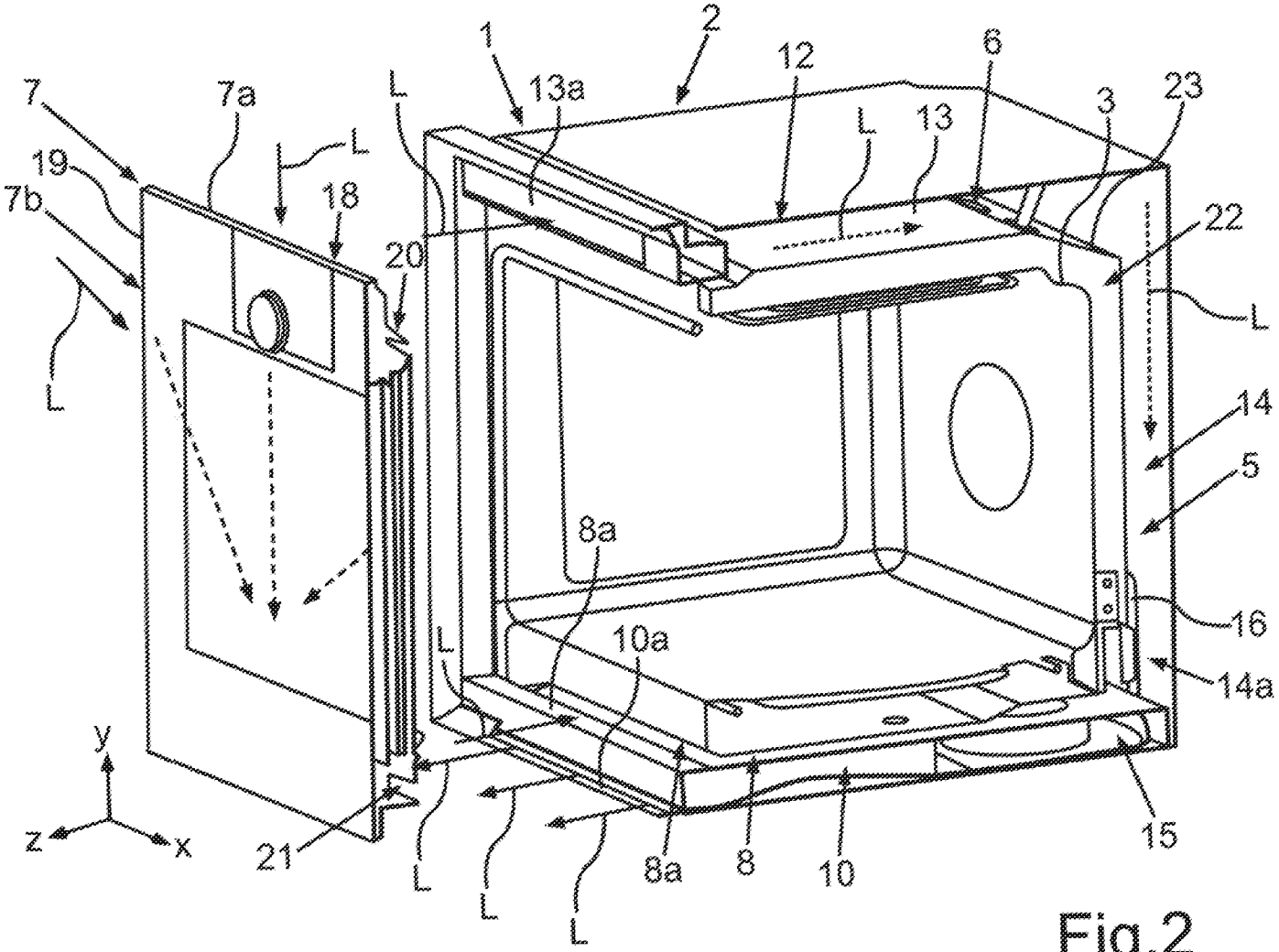
FIG. 2 shows a perspective vertical sectional view of an exemplary embodiment of a cooking appliance according to the invention in which the door is shown removed from the housing in order to be able to show the airflow in an improved manner.

As can be identified in the perspective sectional view in FIG. 2, on a door upper edge 7*a* the door 7 has an inlet 18 of the door-side inflow channel 17. In one exemplary embodiment, on opposing vertical door side edges 7*b* (the opposing door side edge cannot be identified in FIG. 1 and FIG. 2 due to the sectional view) the door 7 has in each case two further inlets 19 via which the air L is also suctioned from the surroundings into the door 7 when the fan 15 is activated. The air L is suctioned thereby into the door 7, in particular through three separate inlets 18, 19. As shown by the dashed lines in FIG. 2, the airflow in the door 7 takes place exclusively from top to bottom.

The inflow channel 17 also has an upper outlet 20. In one exemplary embodiment, when viewed in the height direction, the upper outlet 20 is at the same height as the inlet 13*a* of the first sub-region 13 of the further inflow channel 12 in the housing 2. Thus air L, as is indicated both in FIG. 1 and in FIG. 2, can flow directly out of this outlet 20 of the door 7 into this further inflow channel 12.

Moreover, the door 7 has a lower outlet 21 as shown in FIG. 2. Through this lower outlet 21 air L is suctioned from the door 7 directly to the inlet 8*a* of the inflow channel 8 in the housing 2.

A cavity 22 in which the thermally insulating material is arranged outside the muffle 3 is also shown in FIG. 2. This cavity 22 is defined by further walls 23 so that the flow channels of the flow channel system 6 in the housing 2 toward the muffle 3 are defined by these walls.

The cooking appliance 1 has a width (measured in the width direction or x-direction) having a dimension of 60 cm.

The invention claimed is:

1. A cooking appliance, comprising:

a housing;

a muffle arranged in the housing and designed to define a cooking chamber;

a door movably arranged on the housing and designed to close the cooking chamber; and a flow channel system designed to conduct air suctioned into the cooking appliance from the surroundings of an upper region of the door of the cooking appliance in flow channels of the flow channel system in order to cool the door and the housing, said flow channel system, when viewed in a height direction of the cooking appliance, including an inflow channel extending in the housing and below the muffle such that air flowing through the inflow channel flows from an interior of the door into the housing, and an outflow channel extending separate from the inflow channel in the housing and below the muffle such that air flows via the outflow channel out of the housing, wherein the inflow channel and the outflow channel are arranged one over the other when viewed in the height direction, wherein the flow channel system includes a further inflow channel which extends in the interior of the door and in a direction from the upper region of the door to a lower region of the door and which is coupled in terms of flow technology to an inlet of the inflow channel in the housing below the muffle such that air flowing through the further inflow channel flows through the interior of the door in a direction from top to bottom of the door and, without discharge to an ambient environment, is discharged from the interior of the door directly into the inflow channel in the housing.

2. The cooking appliance of claim 1, wherein the inflow channel is arranged above the outflow channel.

3. The cooking appliance of claim 1, wherein the inflow channel and the outflow channel are separated from one another by a common defining wall.

4. The cooking appliance of claim 1, wherein the inlet of the inflow channel, when viewed in a depth direction of the cooking appliance, forms a front end of the inflow channel, and wherein the further inflow channel includes one or more lower outlets arranged on the door and facing the inlet of the lower inflow channel when this door is closed.

5. The cooking appliance of claim 4, wherein the inlet extends over at least 70% of a width of the muffle, when measured in a width direction of the cooking appliance.

6. The cooking appliance of claim 4, wherein the inlet extends over at least 70% of a width of the housing, when measured in a width direction of the cooking appliance.

7. The cooking appliance of claim 4, wherein the outflow channel has an outlet which, when viewed in a depth direction of the cooking appliance, forms a front end of the outflow channel, wherein, when viewed in the depth direction, the inlet of the inflow channel and the outlet of the outflow channel are located at a same depth position.

8. The cooking appliance of claim 1, wherein the outflow channel has an outlet which, when viewed in a depth direction of the cooking appliance, forms a front end of the outflow channel, and wherein the outlet of the outflow channel faces a surface of the door when the door is closed.

9. The cooking appliance of claim 8, wherein the outlet extends over at least 70% of a width of the muffle.

10. The cooking appliance of claim 8, wherein the outlet extends over at least 70% of a width of the housing.

11. The cooking appliance of claim 1, further comprising a fan arranged below the muffle when viewed in the height direction of the cooking appliance.

12. The cooking appliance of claim 11, wherein the fan is arranged entirely below the muffle.

13. The cooking appliance of claim 11, wherein the fan is arranged in a depth direction of the cooking appliance to a rear of an inlet of the outflow channel and in the height direction at a height of the inlet of the outflow channel.

14. The cooking appliance of claim 11, wherein the outflow channel is arranged in a direction of flow of the air in a positive pressure region of the fan and the inflow channel is arranged in a negative pressure region of the fan.

15. The cooking appliance of claim 11, wherein the fan is a BLDC centrifugal fan.

16. The cooking appliance of claim 1, wherein the flow channel system includes another further inflow channel which has a first sub-region which extends in the height direction from front to back in the housing and above the muffle, and a second sub region which adjoins the first sub-region and which is located in a depth direction to a rear of the muffle and extends from top to bottom in the housing, wherein an outlet of the second sub-region is coupled in terms of flow technology to an inlet of the outflow channel.

17. The cooking appliance of claim 16, further comprising a catalyzer arranged in the second sub-region.

18. The cooking appliance of claim 1, wherein the inflow channel extends in the housing from front to back entirely below the muffle in a depth direction.

19. A cooking appliance, comprising:

a housing;

a muffle arranged in the housing and designed to define a cooking chamber;

a door movably arranged on the housing and designed to close the cooking chamber; and a flow channel system designed to conduct air suctioned into the cooking appliance from the surroundings of the cooking appliance in flow channels of the flow channel system in order to cool the door and the housing, said flow channel system, when viewed in a height direction of the cooking appliance, including an inflow channel extending in the housing and below the muffle such that air flowing through the inflow channel flows from the door into the housing, and an outflow channel extending separate from the inflow channel in the housing and below the muffle such that air flows via the outflow channel out of the housing, wherein the inflow channel and the outflow channel are arranged one over the other when viewed in the height direction, wherein the flow channel system includes a further inflow channel which extends in the door and has a plurality of inlets, and an outlet which is coupled in terms of flow technology to an inlet of the inflow channel in the housing below the muffle, and wherein the plurality of inlets are arranged on a door upper edge and on door side edges.

20. A cooking appliance, comprising:

a housing;

a muffle arranged in the housing and designed to define a cooking chamber;

a door movably arranged on the housing and designed to close the cooking chamber; and a flow channel system designed to conduct air suctioned into the cooking appliance from the surroundings of the cooking appliance in flow channels of the flow channel system in order to cool the door and the housing, wherein the flow channel system, when viewed in a height direction of the cooking appliance, comprises:

a lower inflow channel extending in the housing and below the muffle such that air flowing through the lower inflow channel flows from an interior of the door into the housing;

an outflow channel extending separate from the lower inflow channel in the housing and below the muffle such that air flows via the outflow channel out of the housing to an ambient environment, wherein the lower inflow channel and the outflow channel are arranged one over the other when viewed in the height direction; and a further inflow channel which extends in the interior of the door, wherein the further inflow channel includes:

one or more inlets arranged on at least one of a door upper edge of the door, one or more door side edges of the door, or a combination thereof; and one or more lower outlets arranged on the door and facing an inlet of the lower inflow channel in the housing when this door is closed and coupled in terms of flow technology to the inlet of the lower inflow channel in the housing below the muffle such that air flowing through the further inflow channel flows in the interior of the door in a direction from top to bottom of the door and, without discharge to an ambient environment, is discharged from the interior of the door directly into the inlet of the lower inflow channel in the housing below the muffle.

21. The cooking appliance of claim 20, wherein the flow channel system further comprises:

an upper inflow channel in the housing comprising:

a first sub-region which extends from front to back in the housing and above the muffle; and a second sub region which adjoins the first sub-region and which is located to a rear of the muffle and extends from top to bottom in the housing, wherein an outlet of the second sub-region is coupled in terms of flow technology to an inlet of the outflow channel; and wherein the further inflow channel in the door includes one or more upper outlets on the door, the one or more upper outlets coupled in terms of flow technology to an inlet of the upper inflow channel in the housing above the muffle.

* * * * *